United States Patent [19]

Lehmann

[11] Patent Number: 4,485,504

[45] Date of Patent: Dec. 4, 1984

[54] DEVICE FOR CARRYING DISABLED OR SICK PERSONS

[75] Inventor: J. C. L. Lehmann, Lorch, Fed. Rep. of Germany

[73] Assignee: Binz GmbH U Co, Lorch, Fed. Rep. of Germany

[21] Appl. No.: 398,393

[22] Filed: Jul. 14, 1982

[30] Foreign Application Priority Data

Aug. 29, 1981 [DE] Fed. Rep. of Germany ..... 8125289

[51] Int. Cl.[3] ..... A61G 1/00

[52] U.S. Cl. ..... 5/82 R; 5/425; 296/20

[58] Field of Search ..... 296/20; 297/480, 483, 297/484; 280/806, 81 R, 82 R, 82 B, 89, 425, 494

[56] References Cited

U.S. PATENT DOCUMENTS

| | | | |
|---|---|---|---|
| 1,131,987 | 3/1915 | Bizon | 5/82 |
| 3,046,982 | 7/1962 | Davis | 5/82 |
| 3,204,256 | 9/1965 | Stollenwerk | 5/82 |
| 3,878,844 | 4/1975 | Tobias | 5/424 |
| 4,064,574 | 12/1977 | Schnitzler | 5/82 R |
| 4,115,884 | 9/1978 | Keogh | 5/82 R |

FOREIGN PATENT DOCUMENTS

| | | | |
|---|---|---|---|
| 62312 | 5/1975 | Australia | 5/82 |
| 896515 | 5/1962 | United Kingdom | 280/806 |
| 1173891 | 12/1969 | United Kingdom | 297/484 |
| 1243850 | 8/1971 | United Kingdom | 5/82 |

*Primary Examiner*—Alexander Grosz
*Assistant Examiner*—Michael F. Trettel
*Attorney, Agent, or Firm*—Michael J. Striker

[57] ABSTRACT

A device for carrying sick persons comprises a frame formed as a longeron and covered with a pad, and a safety belt system connected to the frame. The belt system includes a V-shaped portion which is to be extended over the shoulders of a patient and a belt loop to be extended over the legs of the patient. The two portions of the belt system may be connected to each other by a snap closure. The device is further provided with an unrolling arrangement for adjusting the length of the belt loop.

15 Claims, 6 Drawing Figures

DEVICE FOR CARRYING DISABLED OR SICK PERSONS

BACKGROUND OF THE INVENTION

The present invention relates to stretchers in general, and more particularly to devices for carrying disabled or sick persons, provided with a special platform to be placed into a transportation means, such as an ambulance or plane.

Devices for carrying disabled or sick persons of the type under consideration are known in the art. Such a device, particularly for transporting by a plane is described, for example in the article by R. Frey, E. Nagel and P. Safer entitled "Anesthesiology and Resuscitation", Vol. 95, pages 213–226, published by Springer-Verlay Berlin Heidelberg in 1976; the device is illustrated in the photograph 20 on page 225. A safety belt system employed in that device includes a diagonally arranged belt portion which is to be extended over the shoulders of a patient and has inclined belt parts, and a belt portion which embraces the patient's feet and is wound about the frame of the device. In the known device,the end of the so-called shoulder portion of the belt system is expandable and is connected to the end of the feet belt portion. The belt portion extending over the patient's shoulders is utilized in conjunction with a feet pocket provided on the support for the body of a patient, said pocket being arranged above the hinge of the feet portion of the support. The described belt system ensures the fact that a patient lying on the support of the device is firmly held on that support and protected against shocks and vibrations of the transportation means, for example in the case of an accident.

Of course, the belt system described in the above reference can reduce acting forces in a transversal and longitudinal directions so that an injury of a patient, which can occur as a result of colliding the patient against the walls, floor, or ceiling of the transportation means, can be prevented. However, the support for a patient in the emergency case is not optimally adjusted because the known device requires two locks, one for the belt portion extending over the patient's shoulders and another for the above mentioned feet pocket; those locks should be locked up when a patient is laid down onto the stretcher and unlocked when the patent is taken off from the stretcher. Further more, it is quite difficult to maintain both ends of the belt system in a stretched condition simultaneously inasmuch as the end of the belt embracing the feet end portion of the support or the stretcher is subject to considerable friction at the underside of the support. These difficulties have been up to now disregarded and no belt system has been suggested to overcome those difficulties. The belt system for a carrier of sick persons is also disclosed in German Pat. Nos. 12 14828 and 12 47545.

Furthermore, some of the known devices for carrying disabled or sick persons are provided with automatically and independently operated arrangements for expanding and contracting the belt and cooperating with the transverse belt so that the belt can yield upon the movement of the patient and by a forcible movement caused, for example during an accident the normal position of the patient on the stretcher support can be maintained. Eventually, however one end of the transversal belt can slacken so that the belt will serve as a diagonal belt (such arrangements are disclosed in German Pat. Nos. 24 53 246 and 25 43 473 and German published patent application Nos. 25 05 444 and 26 47 186). It is to be further noted that in conventional belt systems of the foregoing type forces acting in the direction of elongation of the support for a patient body, particularly in the area of the patient's shoulders are not sufficiently overcome and the control of a number of transversal and diagonal belts is in the case of emergency troublesome.

In addition, it is to be pointed out that sufficient care is not sometimes given to protection of a patient against potential injury in ambulances and rescue vehicles. In all cases a patient lies on a support which is transported by a vehicle. In all the cases a patient should be strapped on the support to be safely held on the support even in the case of an accident. At the same time a patient lying on the support and fastened thereto should not be too limited in his movements by the belts.

Various traffic accidents involving ambulances carrying patients have been examined for the last two years. In one of the cases when a fatal accident happened in a collision of the ambulance with an individual car it has been found that both vehicles had very high speeds. The investigation of the case has shown that even a driver and an attendant had slight injuries although both were fastened by belts. The patient, however, who lied on the stretcher and was fastened by two wide belts extending over his abdomen was, during the collision forced forwards from the support of the stretcher, thrown against the wall of the ambulance and killed.

Usual devices for carrying sick persons have supports which are according to regulations covered by a plate of plastic or aluminum. On the top of the plate is usually positioned a mattress with two lateral pads. These mattresses are covered with a layer of synthetic plastic material which can be easily cleaned. These mattresses are rarely connected to the supports or plates. Therefore, during a crash caused by high speeds a patient may slide along the mattress or together with the mattress over the plate in a forward direction and slip out of both transverse belts by which the patient was fastened to the support.

In the case when an attendant sits at the head of a patient—this happens rarely during the transportation since that space is usually used for mouth-to-mouth resuscitation or similar procedures—the attendant is subject to a great risk because in such a position the head of a patient lies against the chest of the attendant and during the crash the patient can be thrown against the attendant.

SUMMARY OF THE INVENTION

It is therefore an object of the invention to provide an improved belt system which will reliably hold a patient on the support and will be safe and dependable even during collisions.

It is a further object of the invention to provide a device for carrying disabled or sick persons with a belt system which is easy in operation and can reliably hold a patient lying on the support even during braking of a vehicle into which a patient is placed.

These and other objects of the invention are attained by a device for carrying disabled or sick persons provided with a carrying platform adapted to be installed in transportation means, comprising a rigid frame; and a safety belt system connected to said frame for holding a patient on said frame, said belt system including a first belt portion to be extended over the shoulders of a patient, a second belt portion to be extended over the legs of a patient, a transverse belt portion to be extended under a patient, the first belt portion being of V-shape and being connectable to the transverse belt portion, lock means for connecting the first belt portion and the second belt portion to each other, the lock means including a snap closure having a first part connected to the first belt portion and a second part connected to the second belt portion, the second part of the lock means being releasably-arrestable in the first part of the lock means, and means for independently and automatically adjusting the length of the second belt portion connected to the second belt portion and being operative by a forcible movement imparted to the second belt portion for resiliently extending or contracting the second belt portion in a direction to a feet end of the frame.

The belt system according to the invention requires only one lock, namely one snap closure which can be easily locked or released. Means for adjusting the length of the belt, such as a belt unrolling device operates so as to symmetrically strain the belts extended over the shoulders and the legs of a patient and prevent a patient from possible sliding towards the front end of the support which is particularly important in the case of an accident of a vehicle when increased loads exert on the so-called shoulder portion of the belt system and the shoulder portion of the belt system must hold only a portion of the weight of the patient whereas only relatively small percussion forces act on the spine of the patient. Research has proved that a patient fastened by the belt system disclosed herein is reliably held on the support or frame even during speeding up of the vehicle. Furthermore, the device for adjusting the length of the belts provides for a slight tension of all the belts of the system, particularly that portion thereof which extends over the shoulders of a patient.

The pad for supporting a patient body in the device according to the invention is also reliably held to the frame by the transverse belt even in the case of an accident.

In accordance with further features of the invention the aforementioned second portion of the belt system may include a belt loop. This second portion may also include an additional belt portion extending between the second part of the lock means and the belt loop. The adjusting means may be arranged on the additional belt portion, and the length of the loop will remain unchangeable whereas the length of the additional belt portion can be varied by the adjusting means.

The device for adjusting the length of the belt can be separated from the central snap closure and may be provided with an additional snap closure.

The device for carrying disabled persons according to the invention requires only one arrangement for adjusting the length of the belts and only one snap closure as was mentioned above which can considerably reduce manufacturing costs of the device. The costs of the bolt band can be neglected.

In accordance with further features of the invention the arrangement for adjusting the length of the belt can be positioned on the underside of the frame.

One of the advantages of the present invention resides in that a centrally positioned snap closure does not disturb a patient by its weight.

Preferably, the first belt portion may be releasably connected to the transverse belt portion by an additional snap closure whereby if necessary the belt portion extending over the shoulders of a patient can be easily released and the patient can be lifted together with the pad from the frame, for example if it is necessary to transfer the patient onto the table of an X-ray device. Such a possibility is very important, particularly in the case of a back injury when a careful handling of a patient is required.

According to still further modifications of the invention the frame may include a head portion and a body portion, the head portion being hingeably connected to the body portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
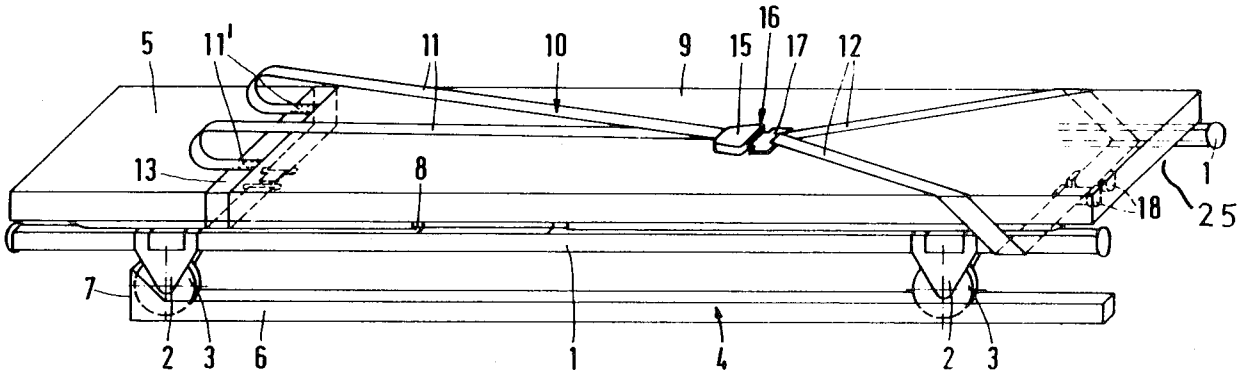
FIG. 1 is a perspective view from the upper side of a device for carrying disabled or sick persons according to a first embodiment of the invention.
Figure 6:
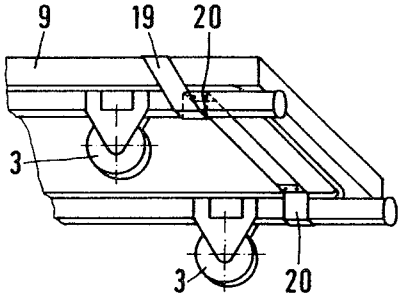
FIG. 6 is a partial perspective view of the underside of the device of FIG. 4 but at another end thereof.
Figure 5:
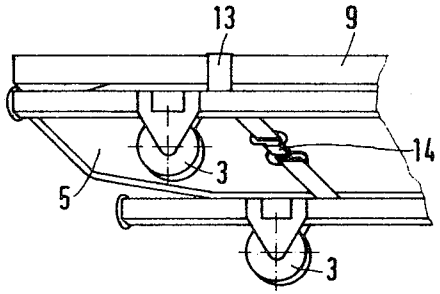
FIG. 5 is a partial perspective view of the underside of the device of FIG. 4 at one end thereof.

Referring now to the drawings and first to FIG. 1 it will be seen that a device for carrying disabled or sick persons includes a longitudinal frame or longeron 1 having four feet 2 (only two feet are illustrated in FIG. 1) each provided with a roller 3.

Rollers 3 are arranged for sliding movement in two opposite elongated rails 4 each having a V-profile and not shown in the drawing in detail. It is to be understood that rails 4 may be mounted in a suitable transportation means, such as an ambulance or airplane. Rails 4 may be also replaced by any suitable platform. Of course, it is to be realized that any conventional locking device for arresting feet 2 with rollers 3 in a locked position should be provided on the device so that the latter would be a rigid and stable unit.

Frame 1 includes a head portion 5 and a body portion 9. Rail 4 at its end facing the front end of the frame has a closed end wall 7, which serves as a stop for the front roller 3 in its sliding movement along the rail. Each rail 4 further includes side walls 6. Front wall 7 of the rail extends upwardly whereby rollers 3 are reliably hold in the rails.

The head portion 5 is hingedly connected to the body portion 9 by means of a tranverse axle 8 whereby head portion 5 can be partially raised or straightened out when desired to assure a sitting position of a patient.

A carrying support 25, such as a pad or a mattress is positioned on the frame 1, which protects a patient against shocks and vibrations in a vertical direction.

In order to ensure the patient's safety and protection against falling down from the mattress during speeding up and braking,and particularly during possible accidents of a transportation vehicle a safety belt system is provided in the device according to the invention.

A safety belt system 10 includes a first portion 11 extending over the shoulders and the upper part of the patient body and a second portion which is a loop 12 extending over the legs of the patient.

Two ends 11' adjacent the patient shoulders are bent and connected at their respective ends to a transverse belt 13 which extends transversally of the pivotable head portion 5 of the frame and surrounds the pad 25. Transverse belt 13 is provided at the underside thereof with a snap closure 14 for connecting two ends of the transverse belt 13 to each other.

The belt portion 11 extends over the pad 25 on which a patient is laid down. Belt portion 11 is of V-shape and is connected at an end thereof opposite to end portions ll' to a lock part 15 of a central snap closure 16, which lock part also holds two belts of belt portion 11 together.

Another lock part 17 of the snap closure 16 is connected to two belts forming the loop 12 which also has a V-shape at its portion extending over the upper side of pad 25.

Loop 12 at its lower side is provided with a device for expanding or contracting the belt of the loop. The device 18 includes a pair of rollers for rolling up and unrolling the portions of the loop 12. This device operates independently when the central snap closure is locked to elastically expand or contract the loop 12 by applying thereto a forcible movement. When such a movement is applied to loop 12 the device 18 adjusts and locks automatically so that the belt system arranged over a patient body is held substantially immovable on the pad 25.

Belt portion 11 should be preferably of such a length that the snap closure 16 will be located somewhere around patient thighs or knees.

Figure 4:
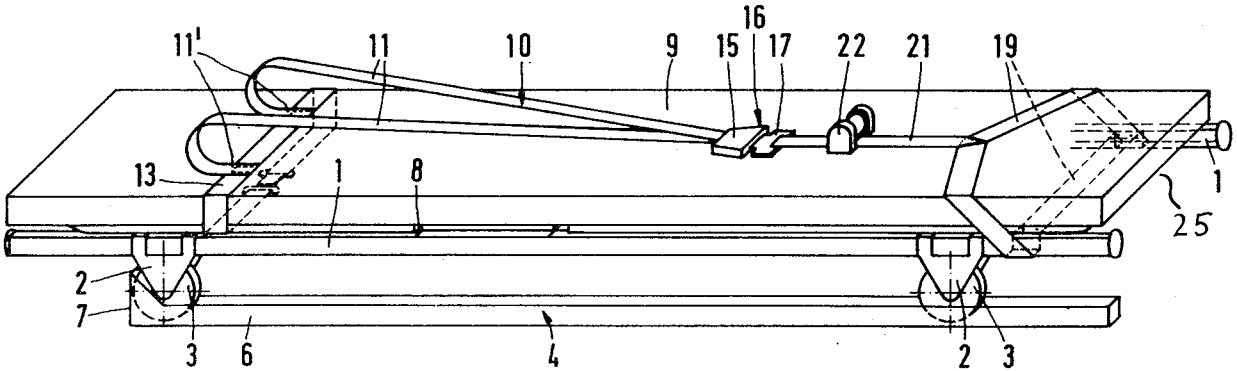
FIG. 4 is a perspective view of another embodiment of the invention.

Reference is now made to FIGS. 3–6 in which another embodiment of the carrying device of the invention is illustrated. The belt portion of the belt system which is to be extended over the legs of a patient includes a loop 19 facing the feet end of pad 25 and a straight belt portion 21 extending between the lock part 17 and loop 19. Loop 19 has a lower side 20 shown in FIG. 6 which is connected to the longeron 1. Loop 19 has a constant unchangeable length in this embodiment of the invention and is arranged to embrace the feet of a lying patient. Loop 19 can be taken off the patient's legs when the snap closure 16 is unlocked. As seen in FIG. 4 belt portion 21 is connected to the lock part 17 of snap closure 16. An adjusting device 22 for expanding or contracting the belt portion 21 is mounted on the belt portion 21. The device 22 operates automatically for resiliently expanding or contracting belt portion 21 due to imparting a forcible movement to that portion. The belt loop 19 has a shape of a closed ring.

Snap closures 14 and 16 may be conventional belt locks which are usually employed in safety belt systems.

In the both embodiments of the invention described above the first belt portion 11 and the second belt portion 12 including only the loop 12 or the loop 19 and the belt portion 21 extend upwardly of the pad 25 so that their engagement with pad 25 is avoided.

A vacuum mattress may be utilized in the device to provide for a greater volume of the pad in place of the usual pad 25.

Figure 3:
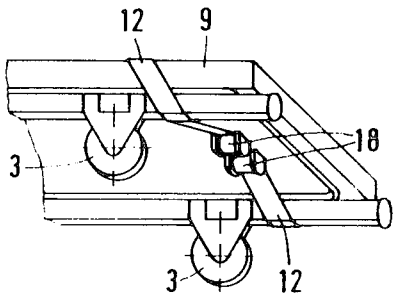
FIG. 3 is a partial perspective view also showing an underside of the device of FIG. 1 but an end thereof opposite to that of FIG. 2.
Figure 2:
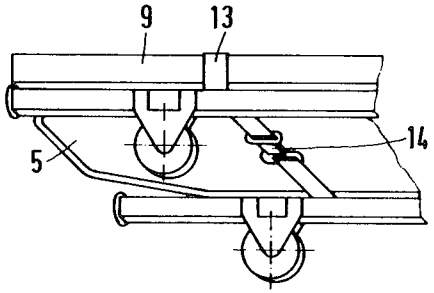
FIG. 2 is a partial perspective view showing an underside of the device of FIG. 1.

If necessary the frame can be formed with a pivotable feet portion similarly to the head portion 5. In the embodiment shown in FIGS. 4–6 loop 19 is connected to the frame at the area of patient feet. In the embodiment illustrated in FIGS. 1–3, the provision of the device with the adjusting arrangement 18 makes it possible that the loop 12 can be always expanded when desired. In each case the belt system of the device always ensures that even when the head portion of the frame or a feet portion thereof are straightened out to adjust for a position of a patient the belt system 10 is always tightened.

It will be understood that each of the elements described above, or two or more together, may also find a useful application in other types of devices for carrying disabled or sick persons differing from the types described above.

While the invention has been illustrated and described as embodied in a device for carrying disabled or sick persons, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A stretcher device for carrying disabled or sick persons provided with a carrying platform adapted to be installed in transportation means, comprising a rigid frame; and a saftey belt system connected to said frame for fastening a patient to said frame, said belt system including a first belt portion to be extended over the shoulders and an upper part of a patient body, a second belt portion to be extended over the legs of a patient, a transverse belt portion to be extend under a patient, said first belt portion being of V-shape and being connectable to said transverse belt portion, lock means for connecting said first belt portion and said second belt portion to each other, said lock means including a snap closure having a first part connected to said first belt portion and a second part connected to said second belt portion, said second part of the lock means being releasably-arrestable in said first part, and means for independently and automaticaly adjusting the length of said second belt portion connected to said second belt portion and being operative by a forcible movement imparted to said second belt portion for resiliently expanding or contracting said second belt portion in a direction to a feet end of said frame, said second portion of said belt system including a belt loop and an additional belt portion extending between said second part of said lock means and said loop.

2. The device as defined in claim 1, wherein said adjusting means is arranged on said additional belt portion.

3. The device as defined in claim 1, wherein said second part of said lock means is connected to said loop.

4. The device as defined in claim 3, wherein said frame has an underside, said adjusting means being positioned on said underside.

5. The device as defined in claim 3, wherein said loop terminates on said underside and is connected to said adjusting means.

6. The device as defined in claim 5, said first belt portion being releasably-connectable to said transverse belt portion by means of a snap closure.

7. The device as defined in claim 6, wherein said frame includes a head portion and a body portion, said head portion being hingeably connected to said body portion.

8. The device as defined in claim 7, further including a pad mounted on said frame, said belt system extending over said pad.

9. A stretcher device for carrying disabled or sick persons, comprising a rigid frame having a mattress thereon and means adapted to be releasably fixed on supporting structures of transportation means; and a safety belt system connected to said frame for fastening a patient to said frame, said belt system including a first belt portion to be extended over the shoulders and an upper part of a patient body, a second belt portion to be extended over the legs of a patient, a transverse belt portion to be extended under and near the shoulders of said patient and being looped around a part of said frame and the mattress thereon, said first belt portion being of V-shape and having ends connected to said transverse belt portion, said second belt portion including a loop part formed by passing around said patient's legs, lock means for connecting said first belt portion and said second belt portion to each other, said lock means comprising a single snap closure having a first part connected to said first belt portion near a V-center thereof and a second part connected to said second belt portion, said second part of the lock means being releasably-arrestable in said first part, and means for independently and automatically adjusting the length of at least a part of said second belt portion connected to said second belt portion and being adapted to be automatically locked by a forcible movement imparted to said stretcher, said adjusting means resiliently pulling said snap closure in a direction to a feet end of said frame, thereby simultaneously keping the first and second belt portions under tension.

10. The device sd defined in claim 9, wherein said second portion of said belt system includes an additional belt portion extending between said second part of said lock means and said loop part of said second belt portion.

11. The device as defined in claim 10, wherein said adjusting means is arranged on said additional belt portion.

12. The device as defined in claim 9, wherein said second part of said lock means is connected to said loop part of said second belt portion.

13. The device as defined in claim 12, wherein said frame has an underside, said adjusting means being positioned on said underside.

14. The device as defined in claim 12, wherein said loop part of said second belt portion terminates on said underside and is connected to said adjusting means.

15. The device as defined in claim 9, wherein said frame includes a head portion and a body portion, said head portion being hingeably connected to said body portion and comprising said transverse belt portion.

* * * * *